US007779911B2

(12) United States Patent
Akselberg

(10) Patent No.: US 7,779,911 B2
(45) Date of Patent: Aug. 24, 2010

(54) METHOD AND MEANS FOR PROVIDING TIME DELAY IN DOWNHOLE WELL OPERATIONS

(75) Inventor: Frank Akselberg, Sandnes (NO)
(73) Assignee: I-Tech AS, Royneberg (NO)

( * ) Notice: Subject to any disclaimer, the term of this patent is extended or adjusted under 35 U.S.C. 154(b) by 117 days.

(21) Appl. No.: 11/918,003
(22) PCT Filed: Apr. 7, 2006

(86) PCT No.: PCT/NO2006/000129

§ 371 (c)(1),
(2), (4) Date: Dec. 14, 2007

(87) PCT Pub. No.: WO2006/107215

PCT Pub. Date: Oct. 12, 2006

(65) Prior Publication Data

US 2009/0078409 A1 Mar. 26, 2009

(30) Foreign Application Priority Data

Apr. 8, 2005 (NO) ..... 20051733
Jul. 29, 2005 (NO) ..... 20053675

(51) Int. Cl.
*E21B 43/00* (2006.01)
*E21B 41/00* (2006.01)
*E21B 31/113* (2006.01)
*F16J 1/00* (2006.01)

(52) U.S. Cl. ..... 166/244.1; 166/243; 92/162 R

(58) Field of Classification Search ..... 166/373, 166/321, 244.1, 243; 92/85 A, 85 B
See application file for complete search history.

(56) References Cited

U.S. PATENT DOCUMENTS 3,399,741 A 9/1968 Monroe (Continued)

FOREIGN PATENT DOCUMENTS

EP 0 482 926 4/1992

(Continued)

OTHER PUBLICATIONS

International Search Report issued Jun. 30, 2006 in the International (PCT) Application of which the present application is the U.S. National Stage.

*Primary Examiner*—David J. Bagnell
*Assistant Examiner*—James G Sayre
(74) *Attorney, Agent, or Firm*—Wenderoth, Lind & Ponack, L.L.P.

(57) ABSTRACT

The present invention relates to an apparatus and method for providing hydraulic load compensated time delay in downhole well operations. The apparatus includes a piston stem enclosed by a piston housing. An axial force, acting either in the direction of stretch or in the direction of compression, causes a pressure buildup in one of two hydraulic chambers which are each filled with an incompressible liquid and which are mutually connected through one or more throttle orifices. A sideways floating, supported piston sleeve is arranged between the piston stem and the piston housing. The piston sleeve is adapted to control the differential pressure across the throttle orifice(s) in such a manner that an increasing axial force will, in a predetermined manner, increase the differential pressure across the throttle orifice(s) and hence delay the flow-through of the incompressible liquid from one of the hydraulic chambers to the other chamber, which also causes a predetermined delay of the relative movement between the piston stem and the piston housing.

13 Claims, 4 Drawing Sheets

U.S. PATENT DOCUMENTS

| | | | | | |
|---|---|---|---|---|---|
| 3,851,717 | A | | 12/1974 | Berryman | |
| 4,114,517 | A | * | 9/1978 | Teramachi | 92/2 |
| 4,179,002 | A | | 12/1979 | Young | |
| 5,343,797 | A | * | 9/1994 | Ochiai et al. | 92/85 A |
| 5,664,629 | A | | 9/1997 | Maitland | |
| 5,887,654 | A | | 3/1999 | Edwards et al. | |
| 5,992,289 | A | | 11/1999 | George et al. | |

FOREIGN PATENT DOCUMENTS

| | | |
|---|---|---|
| GB | 2 102 472 | 2/1983 |
| WO | 2005/116499 | 12/2005 |

* cited by examiner

METHOD AND MEANS FOR PROVIDING TIME DELAY IN DOWNHOLE WELL OPERATIONS

BACKGROUND OF THE INVENTION

The present invention relates to a means for hydraulic load compensated time delay.

In downhole well operations, there is often a need for a means that is able to provide a predetermined time delay in connection with an actuation or initiation of a tool that is to perform some work in the well. Often, it is only possible to actuate such means using tensile and/or compressive forces, for example through wireline operations.

It is further desirable that the time delay is predictable, which can present a challenge when the forces applied to the time delay means, using a long wireline, for example, may be difficult to control. It would be advantageous to be able to minimize the factors that could affect the duration of the time delay obtained in each case, and thereby simplify the calculation of the holding times necessary to effect a particular tool function. By compensating the means that creates the time delay for variations in the forces that are applied to the device, it is possible to achieve as constant, and thereby predictable, time delay as possible.

An example of a mechanically operated tool that may be actuated using a time delay means is a jar. In the actuation of a jar, a means is frequently used that tensions a spring, for example. The spring is released when it has a certain pretension and/or when a predetermined time period has elapsed. A wireline may be used for tensioning the spring, but the time needed for tensioning the spring is difficult to control because the force that is transferred through the wireline may drop off due to friction, stretching, and the like. Moreover, the mechanism generating the force is poorly controllable and hence unsuitable for fine adjustments. Thus, there is a need for a device that control the tensioning of the spring in a jar, for example, so that the tensioning time is largely independent of the tensioning force and any pulls or yanks that may occur. Therefore, it is desired to provide a system that gives a small resistance when the applied force is weak and that gives a larger resistance when the applied force is strong, wherein the resistance profile should be as proportional as possible to the applied force and fast reacting in order to absorb any sudden vigorous pulls.

The present invention provides a means that meets the above-mentioned needs.

BRIEF DESCRIPTION OF THE DRAWINGS

In the following, a detailed description of a preferred embodiment of the present invention is given, with reference to the accompanying drawings, wherein.

DETAILED DESCRIPTION OF THE INVENTION

The present invention provides a time delaying hydraulic system that is based on the flow characteristics of substantially Newtonian fluids.

Figure 1A:
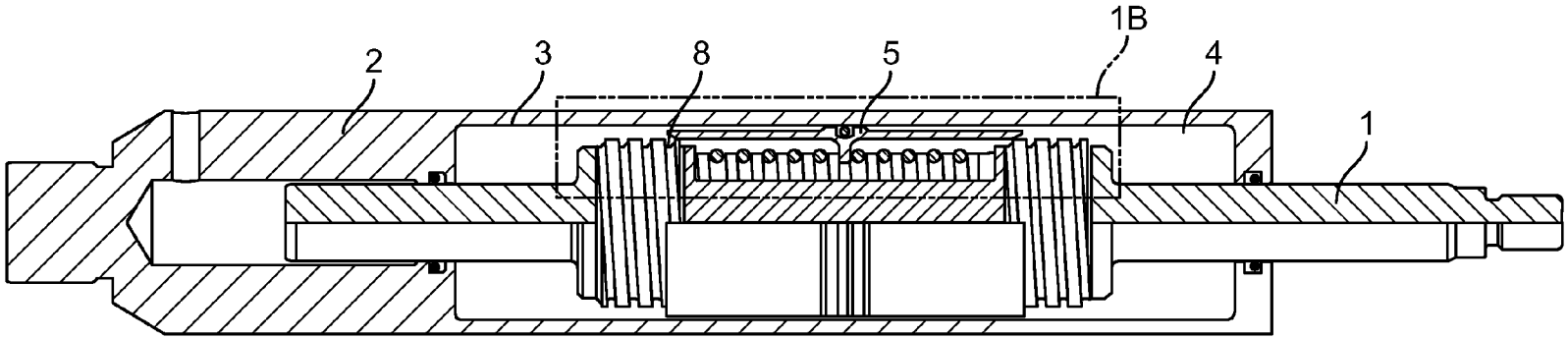
FIG. 1*a* shows a sketch of a first embodiment of the present invention.
Figure 1B:
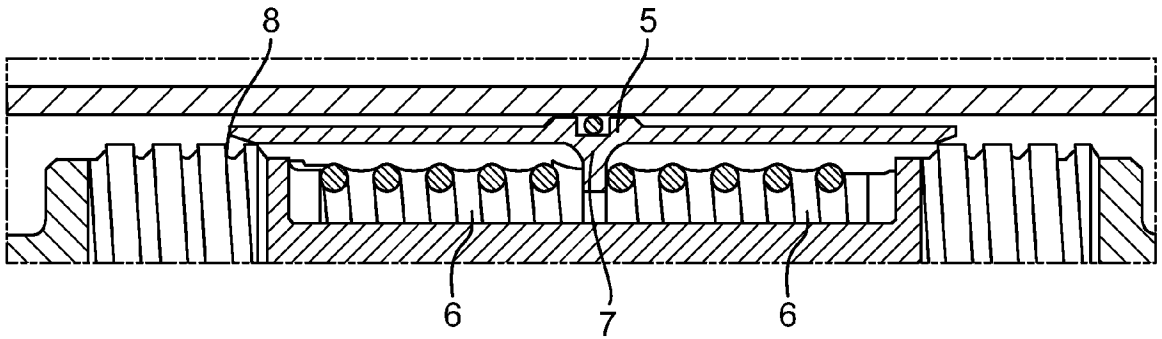
FIG. 1*b* shows a section A of the embodiment shown in FIG. 1*a;*
Figure 2A:
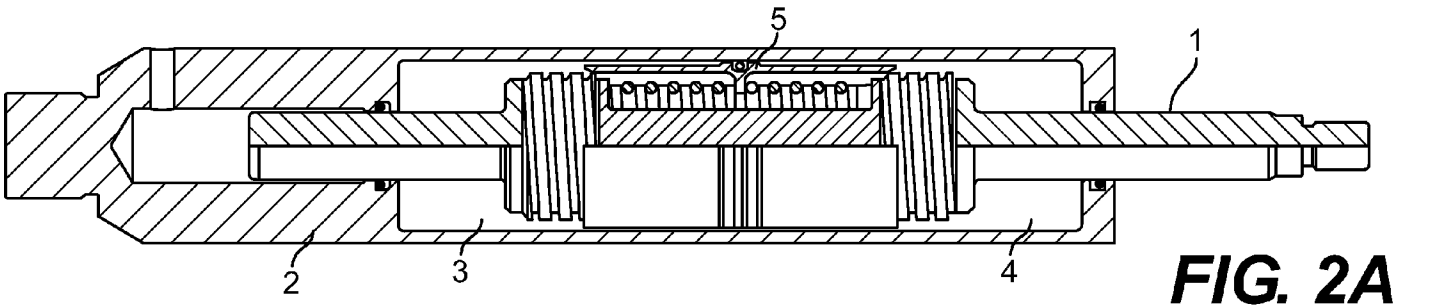
FIGS. 2*a-c* show a sequence of the operation of the embodiment shown in FIG. 1*a;*
Figure 2B:
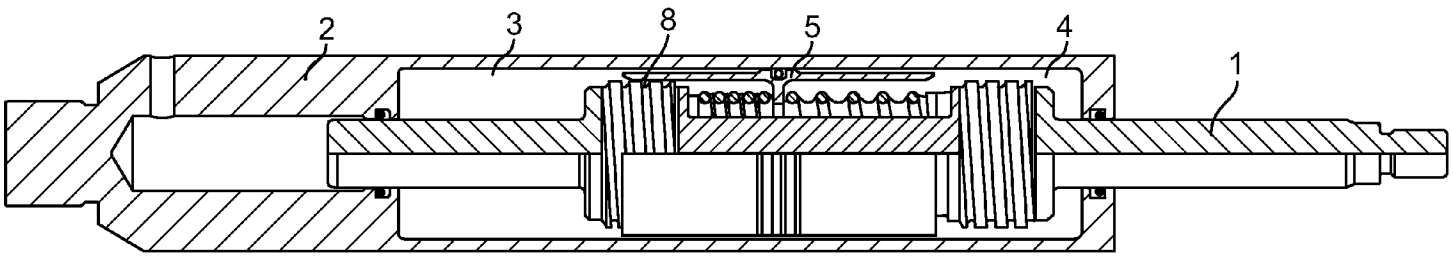
Figure 2C:
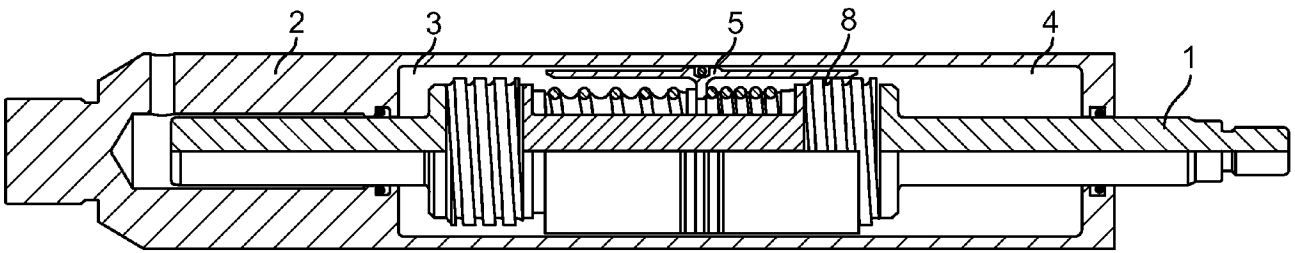
Figure 3A:
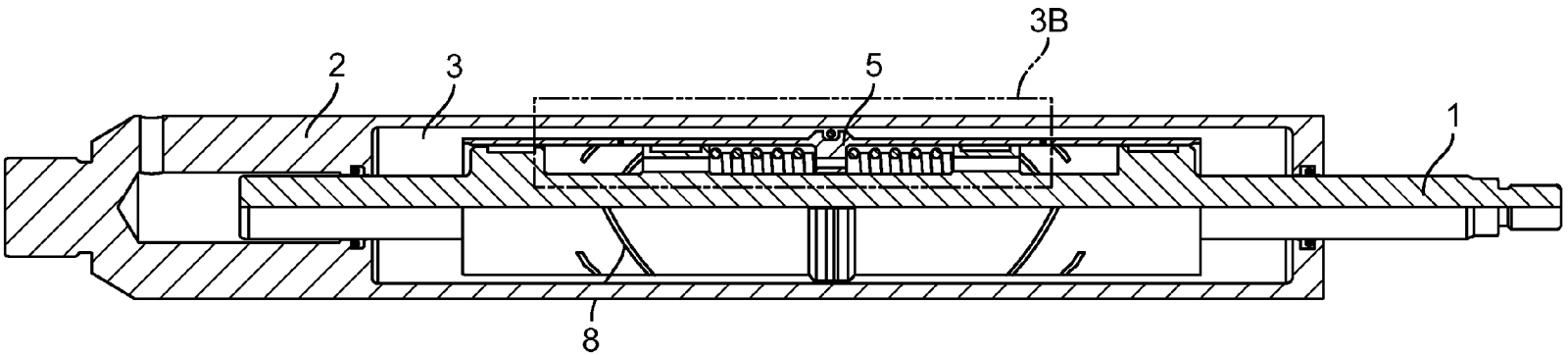
FIG. 3*a* shows a sketch of a second embodiment of the present invention.
Figure 3B:
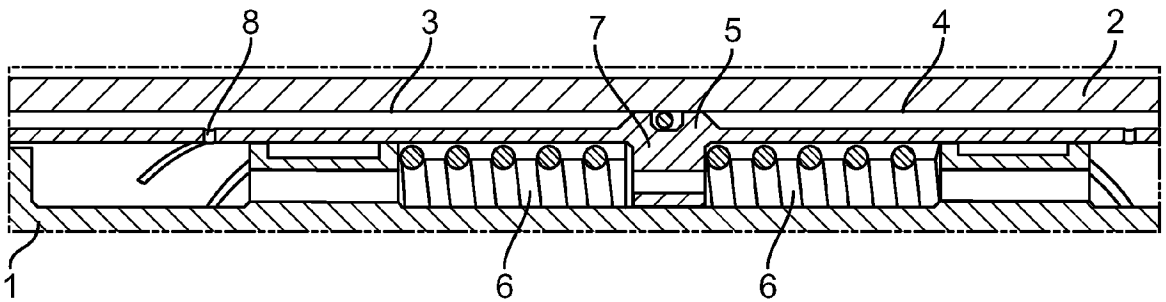
FIG. 3*b* shows a section B of the embodiment shown in FIG. 3*a*.
Figures 4A, 4B, 4C:
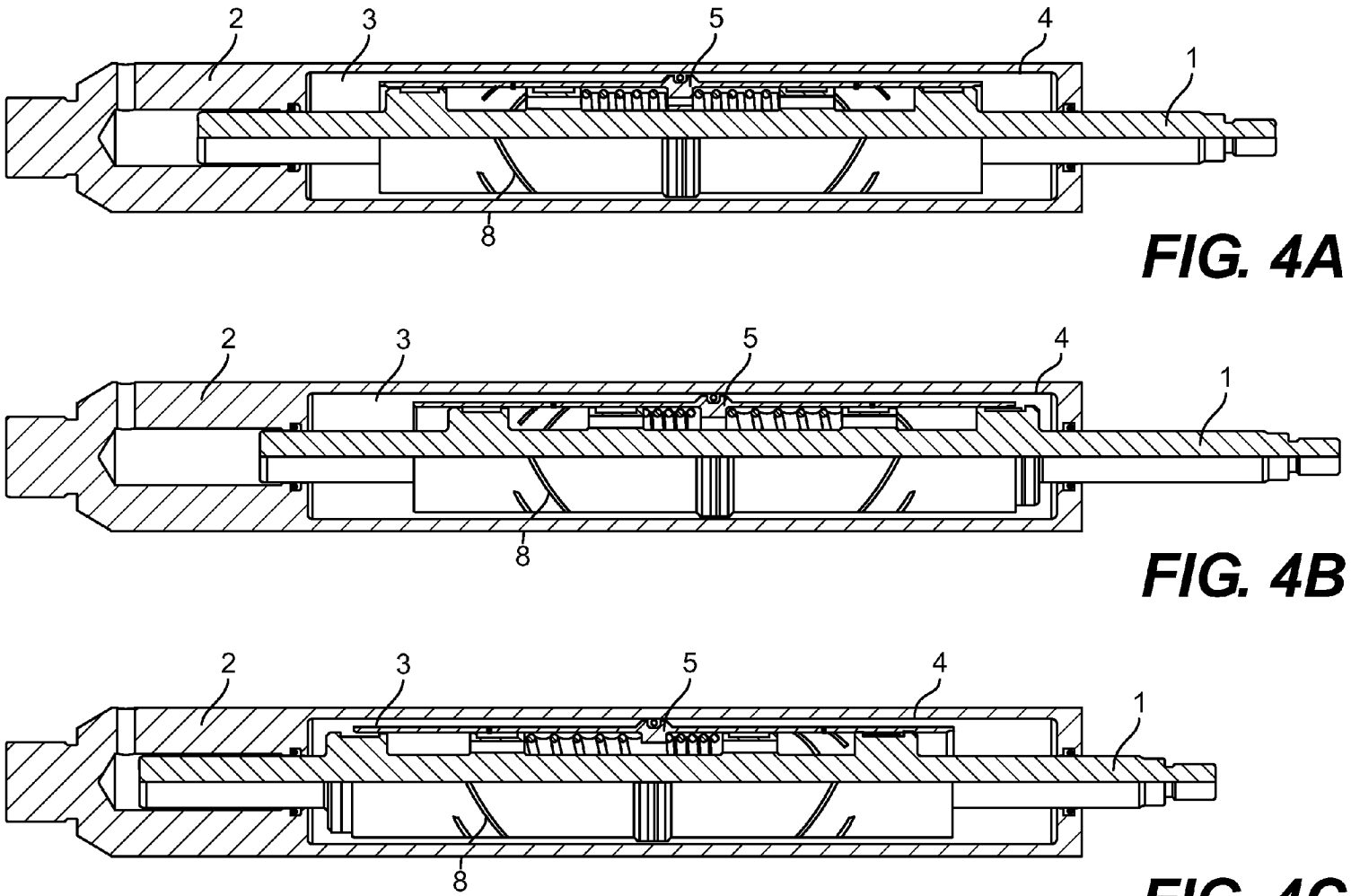
FIGS. 4*a-c* show a sequence of the operation of the embodiment shown in FIG. 3*a*.

FIGS. 1*a* and 3*a* show a section of two variants of a tool providing a hydraulic load compensated time delay. An axial, relative force acting between a piston stem 1 and a cylindrical piston housing 2 enclosing the piston stem 1 causes a pressure buildup in one of two hydraulic chambers 3, 4 which are each filled with an incompressible liquid. Relative movement between the piston stem 1 and the piston housing 2 causes liquid to be displaced from one of the chambers 3 to the other chamber 4, or vice versa. Between the piston stem 1 and the piston housing 2 a sideways floating hydraulic piston sleeve 5 is arranged, supported by a spring 6 on each side of a piston sleeve lug 7. The piston sleeve 5, on an axial movement between the piston stem 1 and the piston housing 2, respectively, causes a liquid flow through a throttle orifice 8, whereby a differential pressure across the throttle orifice 8 is created which is directly dependent on the magnitude of the axial force action, the resulting pressure of which affects the piston sleeve 5 in such a manner that it is given an axial movement relative to both the piston stem 1 and the piston housing 2. On the relative axial movement the area and/or length of the throttle orifice 8 may vary, as the design of the area and/or length of the throttle orifice 8 enables the tool to respond to a variable force action as optimally as possible.

According to one embodiment, the differential pressure is controlled by adjusting the length of the throttle orifice 8. According to a preferred embodiment, this may be accomplished by forming a helical channel around the piston stem, for example, the position of the piston sleeve 5 above the helical channel determining the effective channel length for the hydraulic fluid. This is shown in FIGS. 1*a-b* and 2*a-c*. By forcing the hydraulic fluid to pass through several windings of the helical channel when the acting force is stronger, the length of, and thereby the differential pressure across, the throttle orifice 8 will increase, which will result in the predetermined time delay being obtained independently of the strength and profile of the acting force.

It is understood that the channels may also be arranged on the piston sleeve 5 or on the piston housing 2.

It is well known that the flow resistance of a pipe depends on whether the flow is laminar or turbulent. As long as the flow is laminar, the ratio between the flow and the flow resistance will be linearly increasing. When the laminar flow collapses and becomes turbulent, the flow resistance is significantly reduced. In the present invention, according to one embodiment, the linear properties applicable to laminar flow conditions may be used.

The flow resistance R of a pipe may be expressed by the equation:

$$R = \frac{8\eta L}{\pi r^4},$$

where L is the pipe length, q is the fluid viscosity, and r is the pipe diameter. As can be seen, R increases linearly with the pipe length and increases to the 4th power with a decreasing diameter. By letting the incompressible liquid pass through a pipe having a greater length and/or smaller radius on a stronger force action, a progressive damping is provided. By continuously and dynamically adjusting the ratio between the acting force and the length and/or radius of the throttle orifice, a predetermined time delay independent of the strength and profile of the force action may be obtained.

It is not essential that the throttle orifice 8 be shaped as a helical channel. It may be shaped in any preferred configuration, but a helical channel results in a compact design wherein it is easy to provide a sufficient and accurate channel length that thereby effects the adequate resistance for a given applied force.

According to another embodiment of the present invention, the resistance of the tool will increase in that the piston sleeve 5 covers, and hence reduces, the area of one or more throttle orifices 8, to thereby increase the differential pressure significantly.

FIGS. 3*a-b* and 4*a-c* show an embodiment wherein the throttle orifices 8 are constituted by slots. In the embodiment shown, the slots are formed in the piston sleeve 5, being milled out diagonally with respect to the axial direction of the tool. It is understood that the slots may also be formed lengthwise or crosswise, and that the width of the slots may vary, have a taper, for example. It is also possible to provide a number of holes of same or varying size and/or have varying spacing with respect to the axial displacement of the piston sleeve 5.

The accompanying drawings show a double action tool, i.e. the direction of the force applied to the tool is indifferent. A single action tool that only functions in tensile forces will work equally well, and will in some cases be preferable.

The tool includes a piston stem 1 enclosed by a piston housing 2, and an axial force, acting either in the direction of stretch or in the direction of compression, or alternatively only in one of the directions, causes a pressure buildup in one of two hydraulic chambers 3, 4. The chambers 3, 4 are each filled with an incompressible liquid and are mutually connected through one or more throttle orifices 8. A sideways floating, supported piston sleeve 5 is provided between the piston stem 1 and the piston housing 2. The piston sleeve 5 helps regulate the differential pressure across the throttle orifice(s) 8 in such a manner that an increasing axial force acting on the arrangement will, in a predetermined manner, increase the differential pressure across the throttle orifice(s) and hence delay the flow-through of the incompressible liquid from one of the two hydraulic chambers 3, 4 to the other chamber 4, 3, which also causes a predetermined delay of the relative movement between the piston stem 1 and the piston housing 2. On the application of force, a relative movement between the piston housing 2 and the piston stem 1 with no time delay will occur, the piston sleeve being displaced relative to the housing 2 and stem 1 and balancing between a spring and the hydraulic pressure, for example. The greater the applied force, the greater the stroke of the piston sleeve. In order to compensate for the lost stroke length, the inclination of the channels, slots, or grooves may be made smoothly increasing to thereby obtain a substantially constant time delay independent of the magnitude of the applied force. If holes are provided, their spacing may be varied in order to obtain the same, substantially constant time delay independent of the magnitude of the applied force.

According to one embodiment, the piston sleeve 5 is adapted to close one or more throttle orifices 8 on increasing axial pressure, and thus increase the flow resistance of the incompressible liquid.

According to another embodiment, the piston sleeve 5 is adapted to reduce the size of one or more throttle orifices 8 on increasing axial pressure, and thus increase the flow resistance of the incompressible liquid.

FIGS. 1*a-b* and 2*a-c* shows an embodiment wherein an applied force will cause the piston sleeve 5 to define one or more throttle orifices 8 in the form of one or more channels, the piston sleeve 5 being adapted so that the length of the channel(s) are extended on increasing axial pressure and hence to increase the flow resistance of the incompressible liquid. In this case, the channel or channels have a helical shape, and the channel(s) and the piston sleeve 5 should preferably be shaped in such a manner that the flow through the throttle orifice 8 is laminar.

It is understood that the area of the throttle orifice(s) 8 at any time is adjusted to allow a constant liquid flow through the currently non-blocked throttle orifice(s), independent of the axial force acting between the piston stem 1 and the piston housing 2, to thereby provide the desired time delay.

The area of the throttle orifice(s) 8 may at any time also be adjusted to obtain a constant relative movement between the piston stem 1 and the piston housing 2, independent of the axial force acting between the piston stem 1 and the piston housing 2.

An alternative application of the present invention is as a constant flow valve.

The invention claimed is:

1. An apparatus for providing a hydraulic load compensated time delay, the apparatus comprising:

a piston housing;

a piston stem having a portion enclosed by the piston housing, the portion of the piston stem and the piston housing defining two hydraulic chambers containing an incompressible liquid located on opposite sides of the portion of the piston stem;

a piston sleeve located between the portion of the piston stem and the piston housing; and at least one throttle orifice connecting the two hydraulic chambers, wherein the piston sleeve is adapted to control differential pressure across the at least one throttle orifice.

2. The apparatus of claim 1, wherein the at least one throttle orifice is selected from the group consisting of a hole, a slot and a channel.

3. The apparatus of claim 1, wherein the at least one throttle orifice is a plurality of throttle orifices, and the piston sleeve is adapted to close one or more of the plurality of throttle orifices based on increasing axial pressure, and thus increase flow resistance of the incompressible liquid.

4. The apparatus of claim 1, wherein the piston sleeve is adapted to reduce a size of the at least one throttle orifice based on increasing axial pressure, and thus increase flow resistance of the incompressible liquid.

5. The apparatus of claim 1, wherein the piston sleeve defines at least one channel as the at least one throttle orifice, the piston sleeve being adapted to extend a length of the at least one channel based on increasing axial pressure, thus increasing flow resistance of the incompressible liquid.

6. The apparatus of claim 5, wherein the at least one channel has a helical shape.

7. The apparatus of claim 5, wherein the at least one channel and the piston sleeve are shaped such that flow of the incompressible liquid through the at least one throttle orifice is laminar at least some of the time.

8. The apparatus of claim 6, wherein the at least one channel and the piston sleeve are shaped such that flow of the incompressible liquid through the at least one throttle orifice is laminar at least some of the time.

9. The apparatus of claim 1, wherein an area of the at least one throttle orifice is adjustable to allow a constant flow of the incompressible liquid through the at least one throttle orifice, independent of an axial force acting between the piston stem and the piston housing.

10. The apparatus of claim 1, wherein an area of the at least one throttle orifice is adjustable to obtain a constant relative movement between the piston stem and the piston housing, independent of an axial force acting between the piston stem and the piston housing.

11. A method for providing hydraulic load compensated time delay in an apparatus including a piston housing, a piston stem having a portion enclosed by the piston housing, the portion of the piston stem and the piston housing defining two hydraulic chambers containing an incompressible liquid located on opposite sides of the portion of the piston stem, a piston sleeve located between the portion of the piston stem and the piston housing, and at least one throttle orifice connecting the two hydraulic chambers, the method comprising:

when an axial force acting between the piston stem and the piston housing causes a relative movement between the piston stem and the piston housing and a pressure buildup in one of the two hydraulic chambers, controlling a flow of the incompressible liquid from the hydraulic chamber having the pressure buildup to the other hydraulic chamber through the at least one throttle orifice by controlling differential pressure across the at least one throttle orifice with the piston sleeve, such that the differential pressure across the at least one throttle orifice depends on a magnitude of the axial force acting between the piston stem and the piston housing, the differential pressure causing the piston sleeve to move axially relative to both the piston stem and the piston housing, the relative axial movement between the piston sleeve and the piston stem and/or the piston housing affecting covering or uncovering of the at least one throttle orifice and the differential pressure across the at least one throttle orifice.

12. The method of claim 11, wherein the controlling of the flow of the incompressible liquid comprises adjusting an area of the at least one throttle orifice to allow a constant flow of the incompressible liquid through the at least one throttle orifice.

13. The method of claim 11, wherein the controlling of the flow of the incompressible liquid comprises adjusting an area of the at least one throttle orifice to obtain a constant relative movement between the piston stem and the piston housing, independent of the axial force acting between the piston stem and the piston housing.

* * * * *